US009936777B1

(12) United States Patent
Parkinson et al.

(10) Patent No.: US 9,936,777 B1
(45) Date of Patent: Apr. 10, 2018

(54) SIDEWALKER MOBILITY AID

(71) Applicants: Alan R. Parkinson, Provo, UT (US); Emily Dunford, Provo, UT (US); Bryan Dunford, Provo, UT (US)

(72) Inventors: Alan R. Parkinson, Provo, UT (US); Emily Dunford, Provo, UT (US); Bryan Dunford, Provo, UT (US)

( * ) Notice: Subject to any disclaimer, the term of this patent is extended or adjusted under 35 U.S.C. 154(b) by 0 days.

(21) Appl. No.: 15/714,097

(22) Filed: Sep. 25, 2017

Related U.S. Application Data

(60) Provisional application No. 62/399,917, filed on Sep. 26, 2016.

(51) Int. Cl.

| | |
|---|---|
| ***A45B 1/02*** | (2006.01) |
| ***A45B 9/00*** | (2006.01) |
| *A61H 3/02* | (2006.01) |

(52) U.S. Cl.
CPC ..... *A45B 1/02* (2013.01); *A45B 9/00* (2013.01); *A45B 2009/007* (2013.01); *A61H 3/02* (2013.01)

(58) Field of Classification Search
CPC ..... A45B 1/02; A62H 3/02; A62H 3/04
USPC ..... 135/85
See application file for complete search history.

(56) References Cited

U.S. PATENT DOCUMENTS

| | | | | |
|---|---|---|---|---|
| 2,244,869 | A * | 6/1941 | Everest | A61H 3/04 135/68 |
| 6,217,056 | B1 * | 4/2001 | Tsuchie | A61H 3/04 135/65 |
| D521,720 | S | 5/2006 | Karasin | |
| D528,780 | S | 9/2006 | Karasin | |
| 7,252,105 | B2 * | 8/2007 | Otis | A45B 1/02 135/78 |
| 7,261,113 | B2 | 8/2007 | Tartaglia | |
| 7,261,114 | B2 | 8/2007 | Karasin | |
| 7,673,641 | B2 * | 3/2010 | Karasin | A61H 3/00 135/75 |
| 9,016,297 | B2 | 4/2015 | Salomon | |
| 9,592,175 | B2 * | 3/2017 | Soulakis | A61H 3/02 |
| 2003/0094191 | A1 * | 5/2003 | Lin | A61H 3/04 135/65 |
| 2010/0313923 | A1 | 12/2010 | King | |
| 2012/0139202 | A1 * | 6/2012 | Sigbjornsson | A61H 3/04 280/47.34 |

FOREIGN PATENT DOCUMENTS

| | | | |
|---|---|---|---|
| JP | 2008-136764 | A | 6/2008 |
| JP | 2008136764 | A | 6/2008 |

* cited by examiner

*Primary Examiner* — Noah Chandler Hawk
(74) *Attorney, Agent, or Firm* — Workman Nydegger

(57) ABSTRACT

A sidewalker mobility aid for use in assisting an individual in walking. The device is configured to be used with one hand, on one side of the body of the user, rather than out in front, like a traditional walker. The sidewalker has features that place it between a cane and a walker, in terms of benefits provided. The device provides more lateral resistance (stability) than a typical cane, but less than a traditional walker, while having collapsible features that allow the device to take up less space than a traditional walker.

20 Claims, 7 Drawing Sheets

SIDEWALKER MOBILITY AID

CROSS-REFERENCE TO RELATED APPLICATION

The present application claims the benefit of U.S. Provisional Patent Application No. 62/399,917, filed Sep. 26, 2016, the disclosure of which is herein incorporated by reference in its entirety.

BACKGROUND

1. Field of the Invention

The present disclosure relates to mobility aids, particularly to devices which are less cumbersome and have less stigma associated with their use than a traditional walker, but which provide increased stability as compared to a cane.

2. Related Art

Walkers are readily available, and can provide an individual who has difficulty walking with additional stability and balance. While walkers are good at providing such additional stability in aiding the user in balancing while walking, culturally, there is often a stigma associated with their use. In addition, walkers are much larger, bulkier, and much more cumbersome than a cane, which is problematic when a user is seated or traveling, and when it would be desirable to stow the walker out of the way, either in a room, in a vehicle, or the like.

Canes are also available, but provide significantly less stability and balance, as compared to that provided by a walker. While this is often desirable for those users who do not require the full increase in stability and balance provided by a walker, there are often individuals who would require more assistance than is available from a cane. As such, even with the availability of canes and walkers, there is a need for alternatives that provide more stability and balance than a cane and are less cumbersome and have less stigma than a walker.

SUMMARY

The present disclosure relates to a sidewalker mobility aid that provides greater stability than that provided by a cane, but is not so bulky or intrusive as a walker. Such a device may be configured for use with only a single hand of the user, on one side of the user's body (similar to how a cane is used). Such a device may include a handle assembly including a handle (e.g., a single handle) for one hand (either left or right), on one side of the user's body. The handle assembly may include forward and rearward substantially vertical members, where the handle extends there between. The handle may extend between the substantially vertical members, at the top thereof. Both substantially vertical members may be in a single substantially vertical plane, on one side of the body of the user, during use. As will be described herein, the other components of the sidewalker device may be collapsible into this same plane, resulting in a device that is compact upon collapse, for easy storage and vehicle transport.

The device may further include a forward lateral stability member at a distal end of the forward substantially vertical member of the handle assembly. The forward lateral stability member may extend sideways both towards the body of the user and away from the body of the user, so that the forward lateral stability member provides stability and resistance to lateral force in a sideways direction for the user during use. A rearward lateral stability member may also be provided, at the distal end of the rearward substantially vertical member of the handle assembly, with the rearward lateral stability member extending sideways both towards the body of the user and away from the body of the user, so that the rearward lateral stability member also provides stability and resistance to lateral force in a sideways direction for the user. As noted, either or both of the forward and rearward stability members may be collapsible from their deployed orientation (in which they extend sideways, both towards and away from the body of the standing user grasping the handle), to a collapsed orientation in which they are in substantially the same plane as the handle assembly. By "collapsible", it is meant that such structures have the ability to assume a more compact orientation. Such may be achieved through what may be considered traditional collapse, or through rotation (e.g., rotation of the lateral stability members into substantially the same plane as the handle assembly), or through other means. In a preferred configuration, each respective lateral stability member may be received into the bottom end of the forward or rearward substantially vertical member of the handle assembly, and may rotate within such a coupling, allowing each lateral stability member to swivel from collapsed to deployed, and vice-versa.

In an embodiment, one or both of the substantially vertical members may not be mounted at a center of the respective lateral stability member, but at a location offset relative to the user's body, as compared to a true "center" position. In other words, the extension length of the lateral stability members may be unequal to one another, with such members extending further out (sideways) away from the body of the user, than the extension of the given lateral stability member towards the body of the user. Such a configuration may advantageously minimize any tendency for the user to inadvertently kick or otherwise hit the lateral stability member as they walk, where there is greater extension of the member away from the user, than towards the user.

Methods of use may include providing a sidewalker device as described, and deploying or collapsing the lateral stability member, as appropriate for use. For example, the lateral stability member may be collapsed from the deployed condition as the user prepares to enter a vehicle, and the collapsed sidewalker device may be stowed in its collapsed state, e.g., between the passenger seat of the vehicle and the door, in an overhead bin of a commercial airliner, or the like. Such a method may include retrieving the sidewalker device, and deploying the lateral stability member from the collapsed orientation to the deployed configuration when it is desired to leave such location, and walk elsewhere.

In addition to collapse of the lateral stability member(s) into the plane of the handle assembly, the handle assembly itself may be collapsible vertically as well, allowing the handle assembly to collapse from a given height suitable for use to a smaller height that would be unsuitable for use, but which is helpful in fitting the device into a smaller space, in its collapsed configuration. By way of example, the device may be collapsible so as to occupy a thickness in the plane of the handle that is no greater than 5 inches, no greater than 4 inches, or no greater than 3 inches. The height of the device may collapse to a height of no greater than 22 inches, no greater than 20 inches, or no greater than 18 inches. Such a collapsed configuration may fit within a commercial airliner overhead bin (which bins are typically 22 inches×14 inches×9 inches.

Additional collapsibility could be provided, to render the device even more compact. For example, the forward and rearward substantially vertical members could be configured to collapse towards one another, as well, if desired. The lateral stability members could also be configured to collapse their length, if desired. For example, if the device as deployed had a front to rear dimension of perhaps 10 to 14 inches, it could be collapsed to a front to rear dimension of less than the deployed dimension, reducing the dimensions even further upon collapse.

The sidewalker device may be used on either side of the body. For example, the lateral stability members may be swivelable not only to approximately 90°, putting them into generally the same plane as the handle assembly (i.e., where the lateral stability members are in their collapsed, compact configuration), but they may be swiveled further, allowing reversal of the positioning of the short arm and long arm of each lateral stability member. In this way, the lateral stability members may be rotated 180°, reversing the locations of the short and long arms of the lateral stability members (i.e., to be either on the right, or on the left). Such reversal facilitates use of the sidewalker device with equal ease on either side of the user's body.

In an embodiment, the sidewalker device may include wheels (e.g., retractable wheels) at the ends of one or more of the arms of the lateral stability members, as will be described in further detail hereafter.

These and other advantages and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present disclosure, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings, in which.

DETAILED DESCRIPTION

I. Definitions

Figure 1:
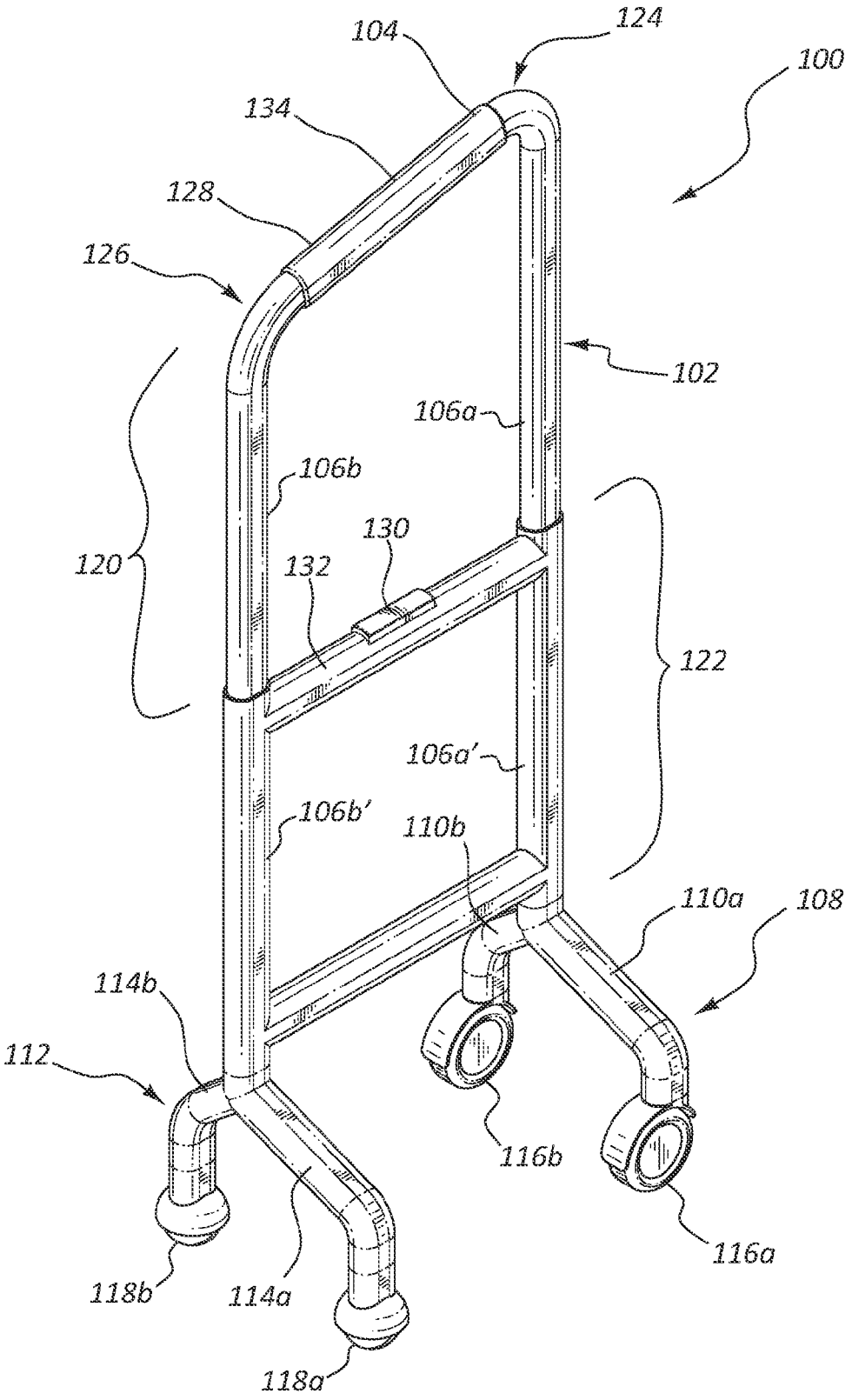
FIG. 1 is a top perspective view of an exemplary embodiment of the sidewalker mobility aid in the deployed, extended configuration, for use.
Figure 2:
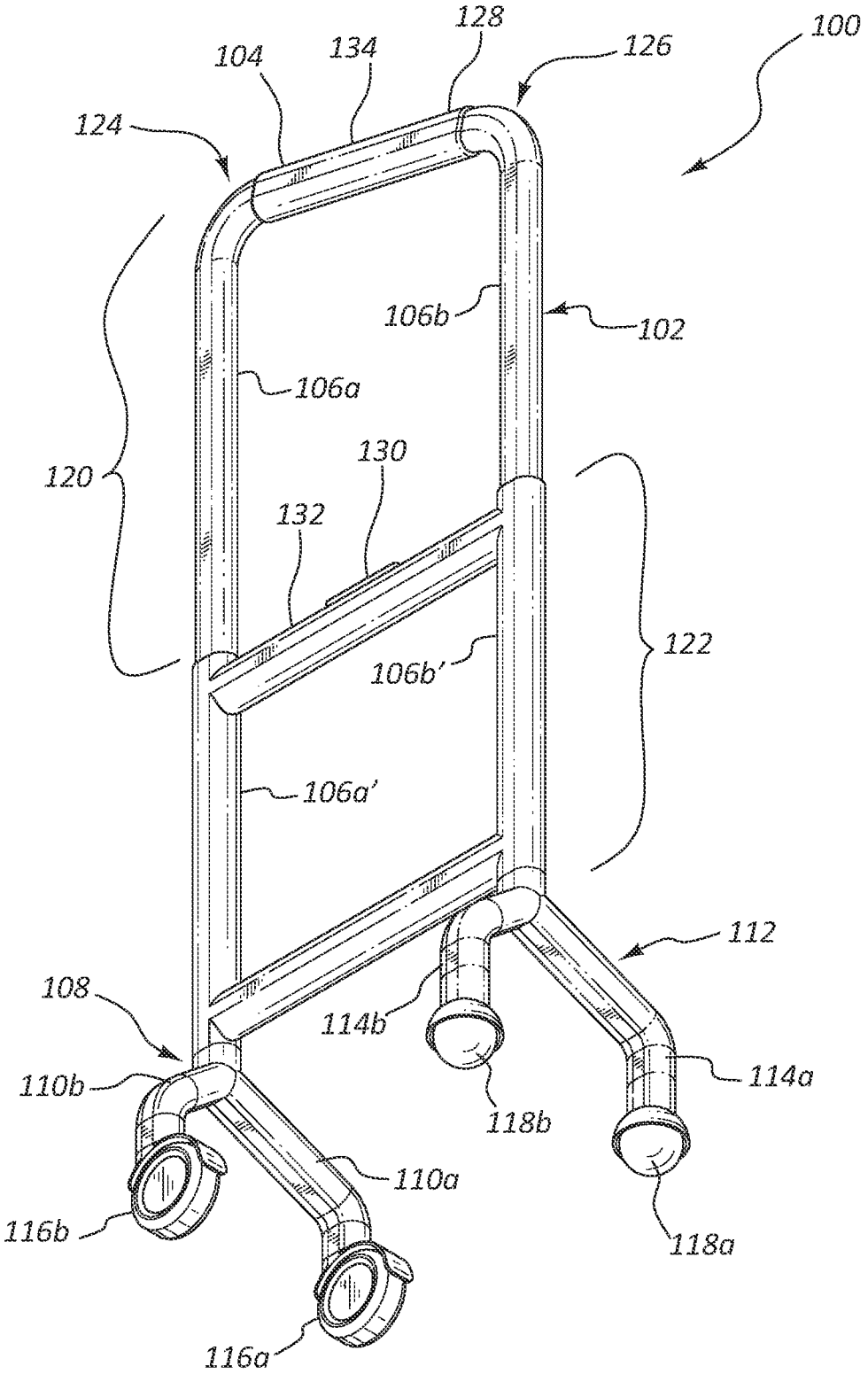
FIG. 2 is a bottom perspective view of the sidewalker mobility aid of FIG. 1.
Figure 3:
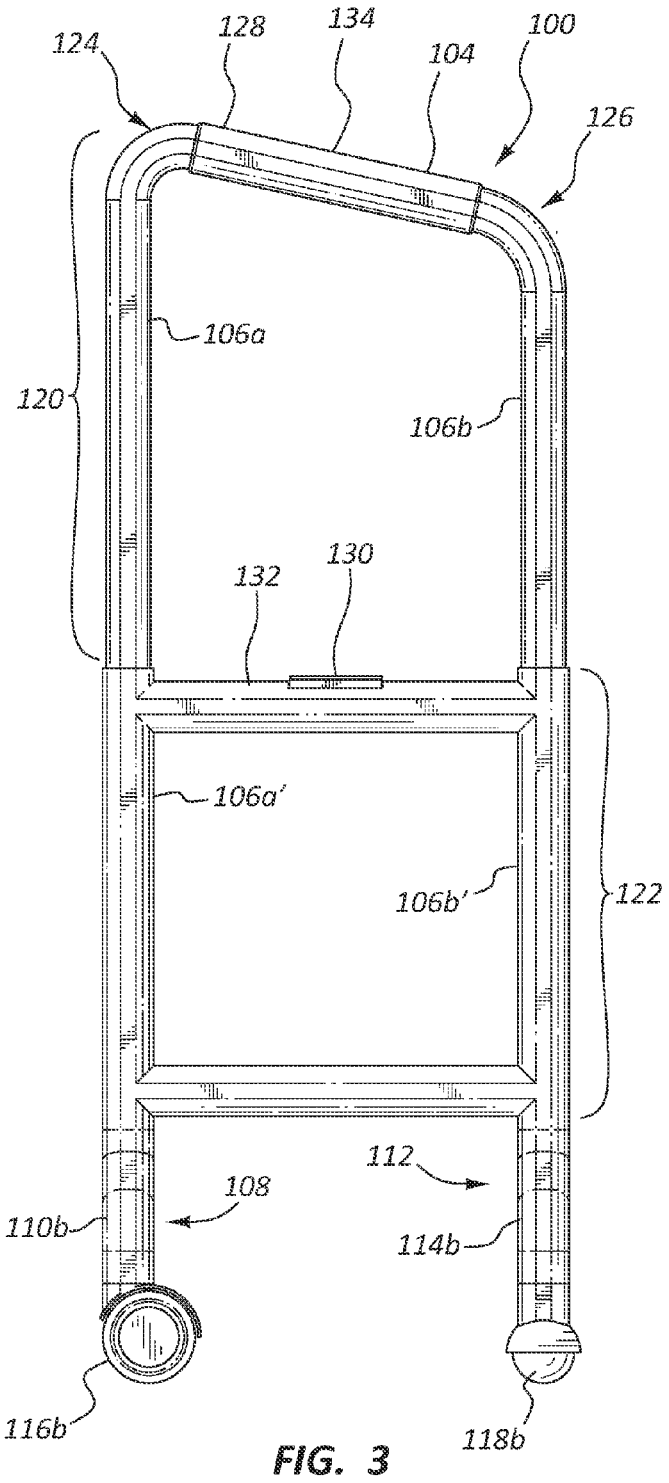
FIG. 3 is a first side view of the sidewalker mobility aid of FIG. 1.

All publications, patents and patent applications cited herein are hereby incorporated by reference in their entirety to the same extent as if each individual publication, patent or patent application was specifically and individually indicated to be incorporated by reference.

Numbers, percentages, or other values stated herein are intended to include that value, and also other values that are about or approximately the stated value, as would be appreciated by one of ordinary skill in the art encompassed by embodiments of the present disclosure. In other words, any value is understood to be modified by the term "about" or "approximately". A stated value should therefore be interpreted broadly enough to encompass values that are at least close enough to the stated value to perform a desired function or achieve a desired result. Stated values may include values that are within 10%, within 5%, within 1%, within 0.1%, or within 0.01% of a stated value.

Ranges between any values disclosed herein are contemplated and within the scope of the present disclosure (e.g., a range defined between any two values given as exemplary for any given parameter).

As used in this specification and the appended claims, the singular forms "a," "an" and "the" include plural referents unless the context clearly dictates otherwise.

As used herein, the terms "comprising," "including," "containing," "characterized by," and grammatical equivalents thereof are inclusive or open-ended terms that do not exclude additional, unrecited elements or method steps, but also include the more restrictive terms "consisting of" and "consisting essentially of" and grammatical equivalents thereof. As used herein, the term "may" with respect to a material, structure, feature or method act indicates that such is contemplated for use in implementation of an embodiment of the disclosure.

II. Introduction

The present invention is directed to a sidewalker mobility aid that is designed to be used with a single hand, on one side of the body (rather than out in front, like a traditional walker). In this sense, it is similar in some respects to use of a cane, although the sidewalker provides lateral stability characteristics that are better than provided by existing canes, so as to provide lateral stability that is perhaps between that provided by a cane and a walker. Advantageously, the lateral stability members are collapsible from their deployed orientation, where they extend sideways both towards and away from the standing body of a user, to a collapsed orientation in which the lateral stability members are (e.g., swiveled) into substantially the same plane as the handle assembly of the sidewalker mobility aid. The handle assembly may also be vertically collapsible, decreasing the overall height of the device for storage (e.g., allowing it to comfortably fit in the space between a passenger seat of a car and the passenger door, in an overhead bin of a commercial airliner, or similar sized space). Such ability makes the device far more practical to store and transport than a traditional walker.

II. Exemplary Sidewalkers

Figure 9:
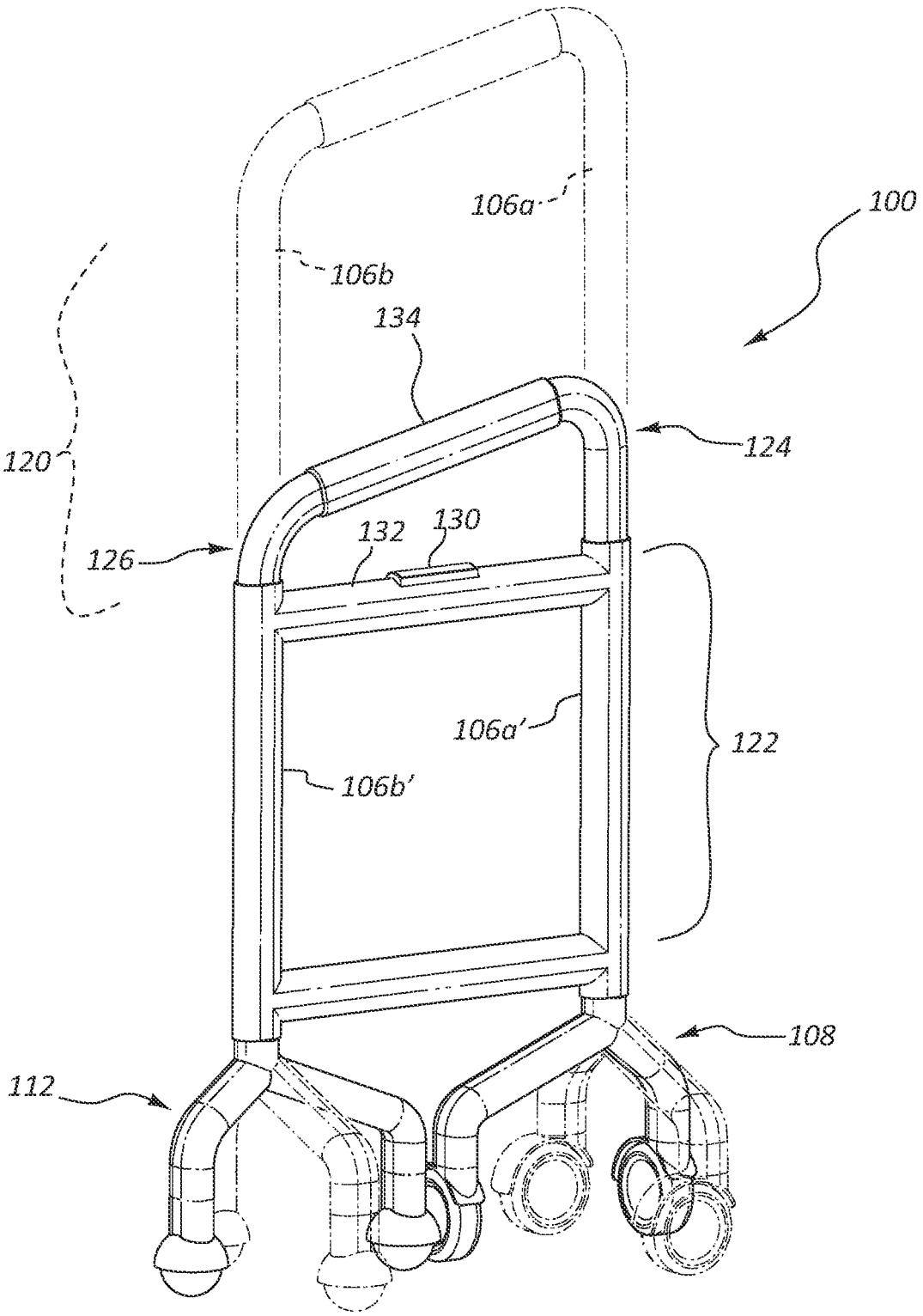
FIG. 9 is a perspective view of the sidewalker mobility aid of FIG. 1, shown in a collapsed configuration, with the handle assembly collapsed downward, and the lateral stability members swiveled into their collapsed configuration, where they are in substantially the same plane as the handle assembly.

FIGS. 1-8 illustrate an exemplary sidewalker device 100 in a configuration in which the handle is vertically extended for use, and the lateral stability members are extended or deployed for use. FIG. 9 shows a perspective view of the same sidewalker 100, in which the handle assembly has been collapsed vertically, and the lateral stability members have also been collapsed, to be in substantially the same plane as the handle assembly.

As shown in FIG. 1, the sidewalker 100 may include a handle assembly 102 including a single handle 104 for one hand. The handle 104 may be in the form of an elongated bar presented on one side (i.e., right or left) of the user using the sidewalker 100. The handle assembly 102 may also include forward and rearward substantially vertical members 106*a*, 106*b*, with the single handle 104 extending there between. The single handle 104 and the forward and rearward substantially vertical members 106*a*, 106*b* may be in a single substantially vertical plane on one side of the body of the user during use. In other words, the handle assembly 102 may be within substantially a single plane, whether in its collapsed state or deployed to one side of the user.

The sidewalker 100 may include a forward lateral stability member 108 at a distal end of the forward substantially vertical member 106*a* of the handle assembly 102. The forward lateral stability member 108 may extend sideways both towards the body of the user and away from the body of the user, so that the forward lateral stability member 108 provides stability and resistance to lateral force in a sideways direction for the user. In the illustrated embodiment, member 108 is shown as including two arms 110*a*, and 110*b*. Arm 110*a* may be disposed away from (i.e., further from) the standing user during use, while arm 110*b* may be disposed towards (i.e., closer to) the standing user during use.

Figure 6:
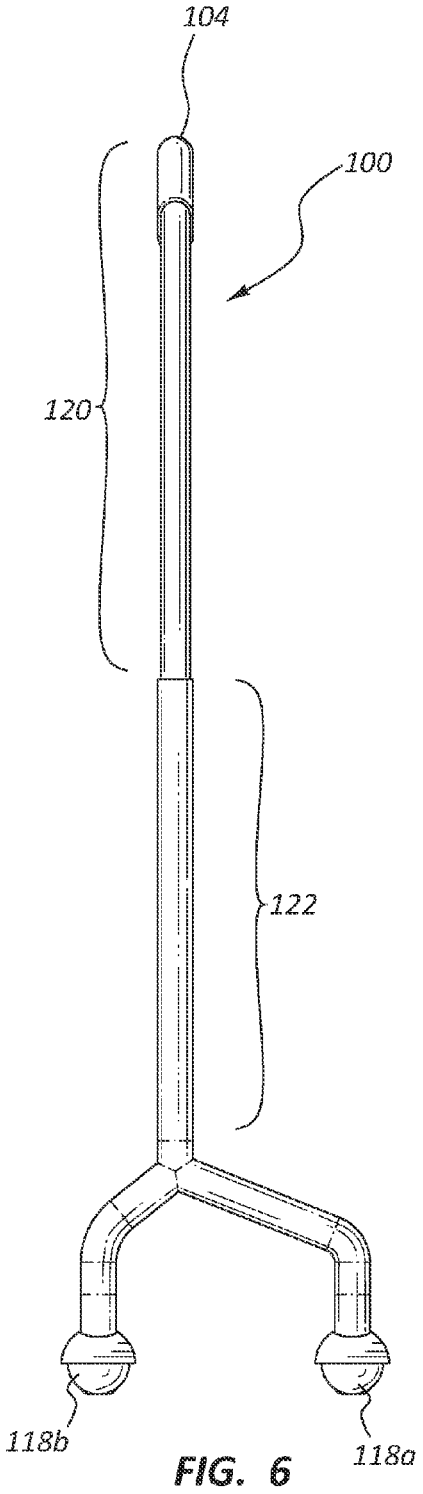
FIG. 6 is a rear view of the sidewalker mobility aid of FIG. 1.
Figure 5:
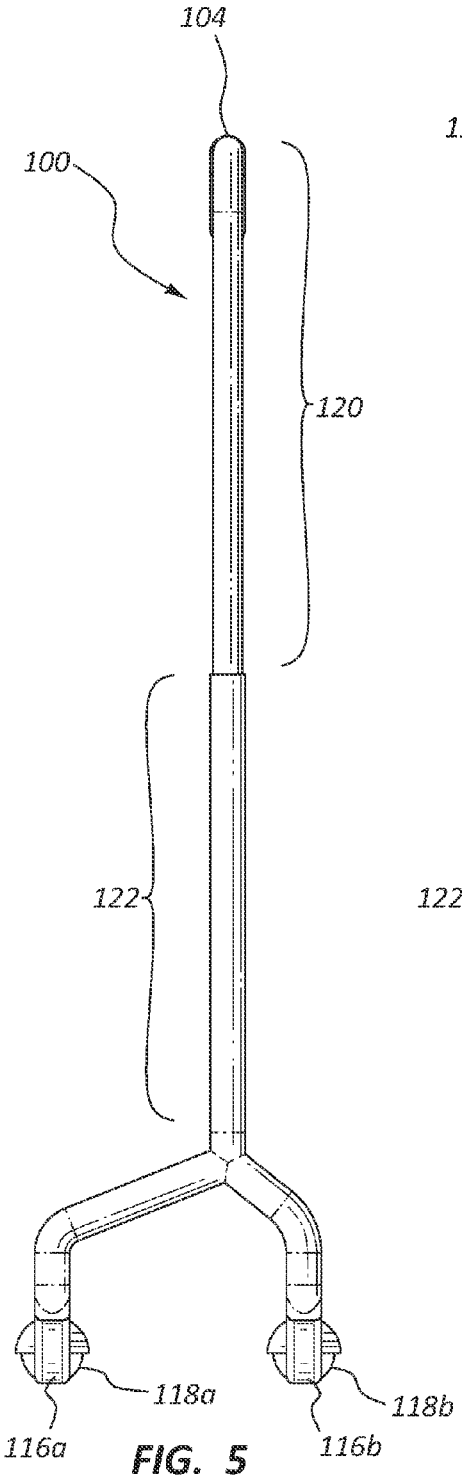
FIG. 5 is a front view of the sidewalker mobility aid of FIG. 1.
Figure 4:
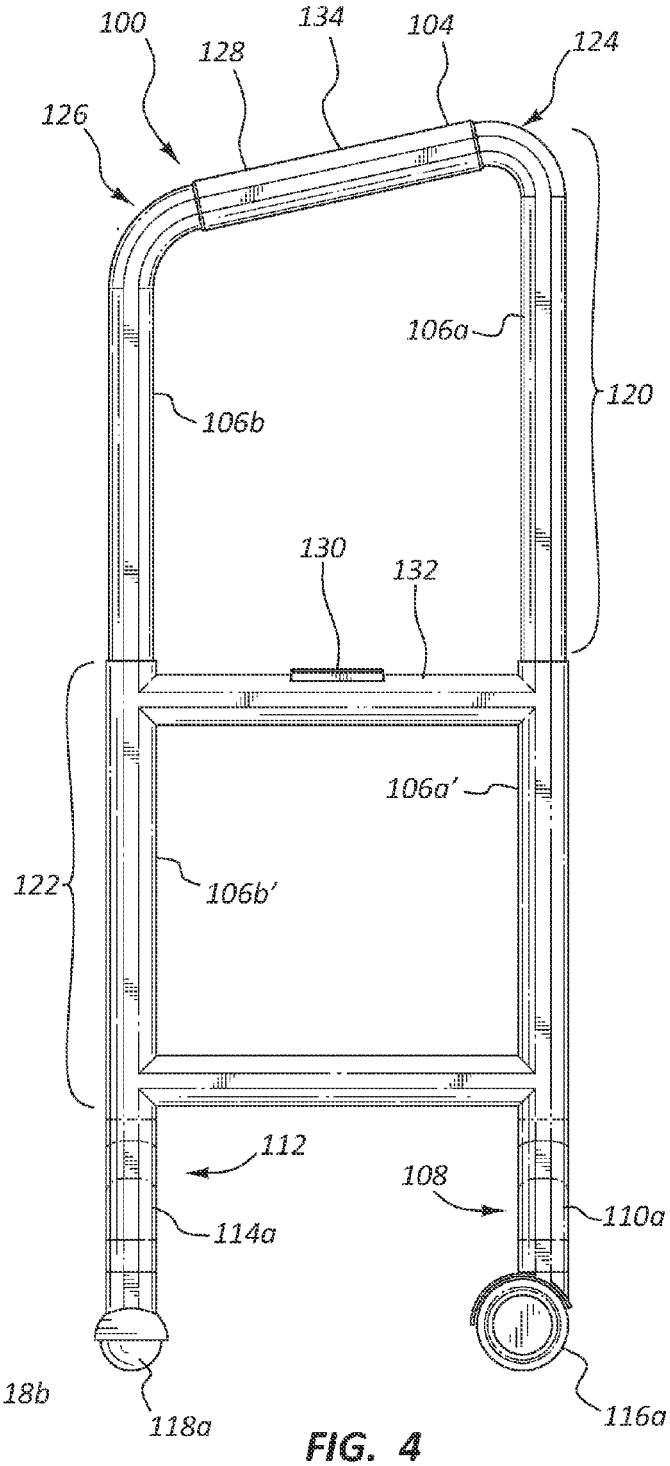
FIG. 4 is an opposite, second side view of the sidewalker mobility aid of FIG. 1.
Figure 7:
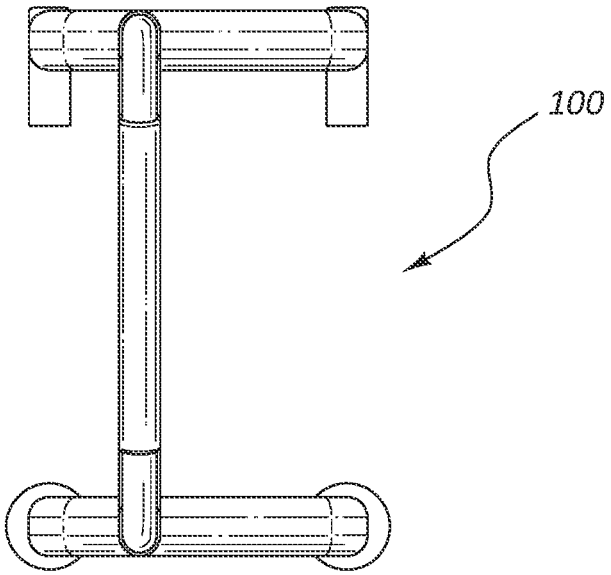
FIG. 7 is a top view of the sidewalker mobility aid of FIG. 1.
Figure 8:
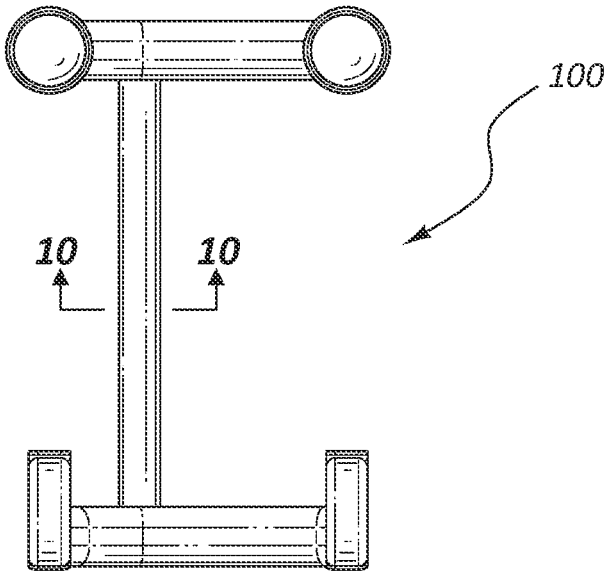
FIG. 8 is a bottom view of the sidewalker mobility aid of FIG. 1.

As may be best appreciated from FIGS. 1, 5, and 6, the forward substantially vertical member 106*a* of the handle assembly 102 may not be attached at a center of the forward lateral stability member 108, but may be noticeably offset therefrom, as shown. In other words, arm 110*b* may be shorter in lateral extension than arm 110*a*. As shown, the offset may be towards the user, which increases the lateral resistance against an outward leaning force from the user and also makes it less likely that the user will step on or trip on the lateral stability member (arm 110*b*) extending towards the user. The lateral stability member 108 thus may extend out further on the side opposite the user (i.e., arm 110*a*), than on the side towards the user (i.e., arm 110*b*), as shown.

A rearward lateral stability member 112 may be provided at a distal end of the rearward substantially vertical member 106*b* of the handle assembly 102, the rearward lateral stability member 112 extending sideways both towards the body of the user and away from the body of the user, so that the rearward lateral stability member 112 provides stability and resistance to lateral force in a sideways direction for the user. This rearward lateral stability member 112 may similarly be offset in its mounting to the rearward substantially vertical member 106*b*, as described above relative to the forward lateral stability member 106*a*, for similar reasons. For example, as shown, member 112 may include arms 114*a* and 114*b*, with arm 114*b* extending towards the user, and arm 114*a* extending away from the user, analogous to arms 110*a* and 110*b*.

The illustrated configuration includes a pair of wheels 116*a*, 116*b* at the front of sidewalker 100, at the distal end of arms 110*a*, 110*b*. A pair of rollers are shown at the rear of sidewalker 100, at the distal end of arms 114*a* and 114*b*. The offset mounting by which arms 110*a* and 114*a* are longer than arms 110*b* and 114*b* provides stability in a sideways direction, providing a point of contact with the ground that is a significant distance away from the user. This provides enhanced side-to-side stability relative to the user's foot or feet. In the illustrated embodiment, wheel 116*a*, and roller 118*a* are shown on this side, furthest from the standing user. Wheel 116*b* and roller 118*b* are shown on the near side, closest to the user, also providing stability, but with less lateral extension so as to not interfere with the user's foot movement.

As perhaps best seen by comparing FIGS. 1 and 9, the sidewalker 100 can be collapsed in two dimensions, both horizontally and vertically. Horizontal collapse may be achieved by rotating, swiveling and/or collapsing the forward and rearward lateral stability members 108, 112 inward so as to be in substantially the same plane as the handle assembly 102. Vertical collapse may be achieved by collapsing an upper portion 120 of handle assembly 102 into a lower portion 122. For example, as shown in the Figures, the handle assembly 102 may include an upper portion 120 and a lower portion 122, where the upper portion 120 may at least partially collapse into the lower portion 122. The single handle 104 may be included within the upper portion 120, and the upper portion 120 may include forward and rearward substantially vertical members 106*a*, 106*b* which collapse downward into substantially vertical members 106*a*', 106*b*' of the lower portion 122. In other words, the forward and rearward substantially vertical members 106*a*, 106*a*', and 106*b*, 106*b*' may be telescoping collapsible.

Collapsibility in both such dimensions provides a great benefit, in that the collapsed sidewalker 100 may easily fit in compact spaces where a walker or cane could not; for example, within the space between a seat and door of a front passenger seat of a car (or the space between the seat and the console, towards the driver's seat). Such collapsibility allows the device 100 to assume a substantially planar configuration, with a collapsed width of perhaps no more than about 5 inches, no more than about 4 inches, or no more than about 3 inches. This collapsibility also allows the sidewalker 100 to easily fit within an overhead bin of a commercial airliner (e.g., 22 inches×14 inches×9 inches), and to do so even with commonly-sized (e.g., carry on) luggage pieces already inserted. For example, because of the narrow collapsed width, the sidewalker may often fit on top of such luggage within an overhead bin. Such is not possible with a traditional walker, and even many canes, which are not readily accommodated within a standard sized commercial airliner overhead bin. Such an ability allows a passenger to take the sidewalker on the plane with them, so that it can be used while boarding the plane, and when deplaning after landing. Such is not possible with a walker, and often not possible with typical canes, which are longer than 22 inches in length.

As shown, the forward lateral stability member 108 made up of arms 110*a*, 110*b* may be provided with wheels 116*a*, 116*b* at or near both ends of arms 110*a*, 110*b*. Rearward lateral stability member 112 is shown as including rollers 118*a*, 118*b* at or near both ends of arms 114*a*, 114*b*. Glides or skids could alternatively be provided with the rearward lateral stability member 112. The illustrated combination of wheels and rollers is helpful in providing a device that can be rolled along the ground, without requiring the user to pick up the device, and without the bulk of a walker. The front wheels 116*a*, 116*b* may be configured as casters, as shown.

The casters may face perpendicular to the arms, and may be configured as "rigid casters" so as not to swivel relative to arms 110*a* and 110*b*, but to only roll back and forth. In other words, the front wheels 116*a*, 116*b* may be fixed relative to arms 110*a*, 110*b*, although they are of course swivelable in combination with arms 110*a*, 110*b* when the member 108 is rotated clockwise (from above) inwardly to collapse arms 110*a*, 110*b* into substantially the same plane as handle assembly 102.

The wheels 116*a*, 116*b* may be of the compression brake style, so that when a user presses downward thereon with a threshold force, the wheels lock, preventing them from further rolling until the threshold force is released. Any of various other mechanisms for selectively locking the wheels may be employed.

The illustrated configuration shows rollers 118*a*, 118*b* mounted within rear arms 114*a*, 114*b*. Such rollers may be of the spherical style, allowing 360° rolling (e.g., forward, rearward, sideways, etc). Of course, a wide variety of other wheels or rollers may alternatively be employed. The functionality of illustrated rollers 118*a*, 118*b* is in contrast to the front wheels 116*a*, 116*b*, which may only roll forward and rearward (i.e., they do not swivel, spin or twist to allow sideways rolling). As shown in FIG. 9, rear arms 114*a*, 114*b* may also be rotated inwardly (counter-clockwise from above), putting arms and rollers 114*a*, 114*b* in substantially the same plane as handle assembly 102.

The single handle 104 of the handle assembly 102 may be forwardly inclined, so that a front 124 of the handle is higher than a rear 126 of the handle 104. Such an inclined bar surface may be more comfortable and more stable for the user than a strictly horizontal surface for the handle 104. As shown, a grip 128 (e.g., an elastomeric, grippable material that increases grip within the hand of the user) may be provided over the single handle bar 104.

A button 130 or other similar mechanism may be provided for allowing selective collapse of the substantially vertical members. While a button 130 is shown, various other mechanisms, e.g., including but not limited to two tabs that squeeze together, allowing selective collapse could also be used. In any case, button 130 is shown within cross-bar 132 of handle assembly 102, where cross-bar 132 is disposed below handle 104, e.g., but above the distal end of the substantially vertical members of handle assembly 102. Button 130 is advantageously not disposed on handle 104, but below handle 104, to minimize any risk of inadvertently collapsing handle assembly 102. Pressing button 130 may permit members 106*a* and 106*b* to collapse vertically downward, into members 106*a*' and 106*b*'. Any suitable mechanism for selectively locking and allowing selective collapse may be employed. Numerous suitable mechanisms for permitting such vertical collapse will be apparent to those of skill in the art, in light of the present disclosure.

By way of example, a height from the middle of handle 104 (e.g., at 134), where a user is most likely to grip, may be approximately 31 inches from this location to the floor (i.e., to the bottom of wheels/rollers 116*a*, 116*b*, 118*a*, 118*b*). Such distance may typically range from 31 inches to 40 inches (i.e., at least about 31 inches). A mechanism may be provided for locking handle 104 at a desired, selected height, within such a range, allowing the user some ability to customize how high the handle is, depending on the height of the user. For example, spring loaded pins and associated receptacle holes within the substantially vertical members of the handle assembly 102 could provide such functionality. Other possible mechanisms will be appreciated by those of skill in the art, in light of the present disclosure. Pressing button 130 could disengage such a pin (e.g., on one or both sides) from the corresponding holes, allowing the handle to be collapsed downward, or extended upward. Such a mechanism may be similar to the pins and holes of a crutch. Such pin retraction mechanism could be operatively coupled to button 130, and hidden within cross-bar 132.

In addition to vertical collapse, the forward lateral stability member 108 (i.e., arms 110*a*, 110*b* with attached wheels 116*a*, 116*b* can be swiveled clockwise (as viewed from above) inwardly, turning arms 110*a* and 110*b* into substantially the same plane as handle assembly 102. Similarly, the rearward lateral stability member 112 (i.e., arms 114*a*, 114*b* with attached rollers 118*a*, 118*b*) can be swiveled counter-clockwise (as viewed from above) inwardly, turning arms 114*a* and 114*b* into substantially the same plane as handle assembly 102. This fully collapsed configuration is shown in FIG. 9.

It will be appreciated that counter-clock wise rotation of forward lateral stability member 108 and clockwise rotation of rearward lateral stability member 112 is also possible, if the user were using the sidewalker on their other side. The swiveling nature of both lateral stability members 108 and 112 allows the user to configure the sidewalker, e.g., as shown in FIG. 1, where the short arms 110*b* and 114*b* are on the right side, configured for the user to stand on the right side, but to also swivel both lateral stability member 108 and 112 180°, so as to position the short arms 110*b* and 114*b* on the left side, allowing the user then to stand on the left side. This ability to swivel the short arms of the lateral stability members to whichever side the user wishes to stand on is particularly advantageous, providing significantly increased versatility.

Figure 10:
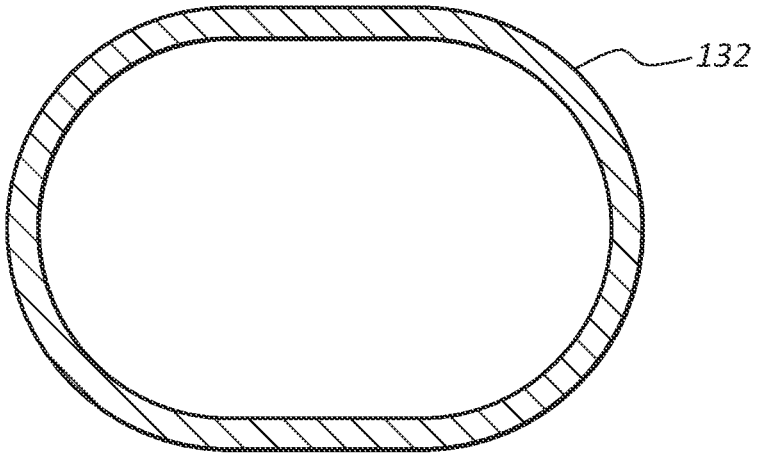
FIG. 10 is a cross-sectional view showing the oval shaped tubing that may be used in the tubing components of the sidewalker mobility aid.

In an embodiment, one or more of the illustrated bar or tubular structures may be formed of a substantially oval tubular cross-sectional shape, which oval cross-section is shown in FIG. 10. Such a generally oval cross-section is symmetrical, so as to better facilitate the above described swiveling through 180° (or even 360°). Such an oval cross-section may be further preferred over a simple circular cross-section as it provides significantly increased stiffness in the long axis. That said, any symmetrical cross-section that would permit alignment after swiveling 180° may be suitable for use.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A sidewalker mobility aid for use with one hand on one side of a body of a user, the sidewalker mobility aid comprising:

a handle assembly including a single handle for one hand, on one side of a body of a user, the handle assembly including forward and rearward substantially vertical members with the single handle extending therebetween, the single handle and the forward and rearward substantially vertical members being in a single substantially vertical plane on one side of the body of the user during use;

a forward lateral stability member at a distal end of the forward substantially vertical member of the handle assembly, the forward lateral stability member extending sideways both towards the body of the user and away from the body of the user, so that the forward lateral stability member provides stability and resistance to lateral force in a sideways direction for the user;

a rearward lateral stability member at a distal end of the rearward substantially vertical member of the handle assembly, the rearward lateral stability member extending sideways both towards the body of the user and away from the body of the user, so that the rearward lateral stability member provides stability and resistance to lateral force in a sideways direction for the user; and wherein both the forward lateral stability member and the rearward lateral stability member are collapsible from their deployed orientation in which they extend sideways both towards and away from the body of the user, to a collapsed orientation in which they are in substantially the same plane as the handle assembly.

2. The sidewalker mobility aid of claim 1, wherein the handle assembly includes an upper portion and a lower portion, the single handle being included within the upper portion, and wherein the upper portion includes forward and rearward substantially vertical members which collapse downward into substantially vertical members of the lower portion.

3. The sidewalker mobility aid of claim 2, wherein the handle assembly comprises a button disposed on a cross-bar of the handle assembly, the button being operatively coupled to the handle assembly to facilitate selective downward collapse of the upper portion into the lower portion.

4. The sidewalker mobility aid of claim 1, wherein the sidewalker mobility aid is collapsible to a collapsed width of about 5 inches or less.

5. The sidewalker mobility aid of claim 1, wherein the sidewalker mobility aid is collapsible to a collapsed width of about 4 inches or less.

6. The sidewalker mobility aid of claim 1, wherein the sidewalker mobility aid is collapsible to a collapsed width of about 3 inches or less.

7. The sidewalker mobility aid of claim 1, wherein the sidewalker mobility aid is collapsible to collapsed dimensions so as to fit within an overhead bin of a commercial airliner sized 22 inches×14 inches×9 inches.

8. The sidewalker mobility aid of claim 1, wherein both the forward lateral stability member and the rearward lateral stability member further comprise at least one of wheels or glides extending downward therefrom, for contact with a ground surface.

9. The sidewalker mobility aid of claim 8, wherein both the forward lateral stability member and the rearward lateral stability member comprise wheels extending downward therefrom for contact with the ground surface.

10. The sidewalker mobility aid of claim 9, wherein the wheels of the rearward lateral stability member are configured as generally spherical rollers.

11. The sidewalker mobility aid of claim 9, wherein the wheels of at least one of the forward or rearward lateral stability members are selectively lockable so that when a user presses downward with a threshold force on the handle, the selectively lockable wheels lock so they will not roll.

12. The sidewalker mobility aid of claim 1, wherein the forward and rearward substantially vertical members are not mounted at a center of the forward and rearward lateral stability members, but at a location that is offset towards the body of the user as compared to the center of the forward and rearward lateral stability members.

13. The sidewalker mobility aid of claim 1, wherein the single handle of the handle assembly is forwardly inclined, so that a front of the handle is higher than a rear of the handle.

14. The sidewalker mobility aid of claim 13, wherein the single handle comprises a bar with a grip formed thereover for increasing grip in the hand of the user.

15. A collapsible sidewalker mobility aid for use with one hand on one side of a body of a user, the sidewalker mobility aid comprising:

a handle assembly including a single handle for one hand, on one side of a body of a user, the handle assembly including forward and rearward substantially vertical members with the single handle extending therebetween, the single handle and the forward and rearward substantially vertical members being in a single substantially vertical plane on one side of the body of the user during use;

a forward lateral stability member at a distal end of the forward substantially vertical member of the handle assembly, the forward lateral stability member extending sideways both towards the body of the user and away from the body of the user, so that the forward lateral stability member provides stability and resistance to lateral force in a sideways direction for the user, wherein the forward lateral stability member further includes a pair of wheels mounted at or near the ends of the forward lateral stability member;

a rearward lateral stability member at a distal end of the rearward substantially vertical member of the handle assembly, the rearward lateral stability member extending sideways both towards the body of the user and away from the body of the user, so that the rearward lateral stability member provides stability and resistance to lateral force in a sideways direction for the user, wherein the rearward lateral stability member further includes a pair of wheels mounted at or near the ends of the rearward lateral stability member;

wherein both the forward lateral stability member and the rearward lateral stability member are collapsible from their deployed orientation in which they extend sideways both towards and away from the body of the user, to a collapsed orientation in which they are in substantially the same plane as the handle assembly; and wherein the forward and rearward substantially vertical members are not mounted at a center of the forward and rearward lateral stability members, but at a location that is offset towards the body of the user as compared to the center of the forward and rearward lateral stability members.

16. The sidewalker mobility aid of claim 15, wherein the wheels of the forward lateral stability member are selectively lockable so that when a user presses downward with a threshold force on the handle, the selectively lockable wheels lock so they will not roll.

17. The sidewalker mobility aid of claim 15, wherein the handle assembly includes an upper portion and a lower portion, the single handing being included within the upper portion, and wherein the upper portion includes forward and rearward substantially vertical members which collapse downward into substantially vertical members of the lower portion.

18. The sidewalker mobility aid of claim 15, wherein the single handle of the handle assembly is forwardly inclined, so that a front of the handle is higher than a rear of the handle.

19. The sidewalker mobility aid of claim 15, wherein the sidewalker mobility aid is collapsible to a collapsed width of about 3 inches or less.

20. The sidewalker mobility aid of claim 15, wherein at least the forward lateral stability member and the rearward lateral stability member are formed from tube members that are substantially oval in cross-section.

* * * * *